US006943750B2

(12) United States Patent
Brooker et al.

(10) Patent No.: US 6,943,750 B2
(45) Date of Patent: Sep. 13, 2005

(54) SELF-POINTING ANTENNA SCANNING

(75) Inventors: Ralph L. Brooker, Alexandria, VA (US); Scott H. Walker, Scottsdale, AZ (US); Charles L Lipkin, Naperville, IL (US); David H. Johnson, Wylie, TX (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/051,141

(22) Filed: Jan. 22, 2002

(65) Prior Publication Data

US 2002/0101384 A1 Aug. 1, 2002

Related U.S. Application Data

(60) Provisional application No. 60/271,600, filed on Feb. 26, 2001, and provisional application No. 60/265,142, filed on Jan. 30, 2001.

(51) Int. Cl.[7] ..... H01Q 19/10; H01Q 3/12

(52) U.S. Cl. ..... 343/839; 343/761; 343/781 CA

(58) Field of Search ..... 343/839, 840, 343/761, 763, 765, 766, 781 CA, 757, 758, 880, 882; H01Q 19/10, 3/12

(56) References Cited

U.S. PATENT DOCUMENTS

| | | | | |
|---|---|---|---|---|
| 3,553,731 A | * | 1/1971 | Szirtes | 343/781 CA |
| 3,611,393 A | | 10/1971 | Kibler | 343/761 |
| 4,804,971 A | * | 2/1989 | Bruns et al. | 343/840 |
| 5,874,925 A | * | 2/1999 | Choi | 343/840 |
| 6,166,700 A | * | 12/2000 | Jenkin et al. | 343/761 |
| 6,350,037 B1 | * | 2/2002 | Adams | 359/843 |
| 6,441,798 B1 | * | 8/2002 | Ehrenberg et al. | 343/840 |

FOREIGN PATENT DOCUMENTS

| | | | |
|---|---|---|---|
| GB | 2 344 189 A | 5/2000 | F24J/2/12 |
| JP | 60-51004 | 3/1985 | H01Q/15/20 |
| JP | 60-72304 | 4/1985 | H01Q/3/18 |
| JP | 63-174406 | 7/1988 | H01Q/3/08 |
| JP | 8-288720 | 11/1996 | H01Q/1/12 |
| JP | 2000-82907 | 3/2000 | H01Q/3/18 |

* cited by examiner

*Primary Examiner*—Hoanganh Le
(74) *Attorney, Agent, or Firm*—Jenkens & Gilchrist

(57) ABSTRACT

A self-pointing antenna has a reflector, a feed or a sub-reflector and a plurality of support struts coupled between the reflector and the boom arm and supporting the feed or sub-reflector. At least one actuator is operatively coupled with the support struts for adjusting the position of the feed or sub-reflector relative to the reflector so as to selectively adjust either/or both of the beam elevation and azimuth of a main beam axis of the antenna.

46 Claims, 10 Drawing Sheets

SELF-POINTING ANTENNA SCANNING

CROSS-REFERENCE TO RELATED APPLICATION

This application claims the benefit of priority of U.S. Provisional Patent Application Ser. No. 60/265,142, filed Jan. 30, 2001 and U.S. Provisional Patent Application Ser. No. 60/271,600, filed Feb. 26, 2001.

FIELD OF THE INVENTION

This invention is directed generally to antennas and more particularly to a novel self-pointing antenna and a related method for self-directing or self-adjusting the direction of a main beam axis.

BACKGROUND OF THE INVENTION

While the invention is illustrated and described hereinbelow with reference to a self-pointing satellite antenna, the principles of the invention may be applied to antennas of similar construction used in other applications where it is desired to control or regulate the direction of the main beam of the antenna and/or from time-to-time make adjustments in the beam direction, either elevation, azimuth, or both.

In order to prevent interference and/or signal degradation, fixed earth station antennas must be pointed accurately at the satellite when installed and remain so during their operating lifetimes.

The normal method of mechanically scanning large antennas is to move the entire main reflector structure with large expensive jackscrews. Such designs demand expensive jacks, bearings and mounts to safely move large antennas in high winds. The invention is usable with large antennas with beamwidths so narrow that they must follow the satellite motion within normal fixed box limits of 0.1 degrees while meeting stringent gain and sidelobe requirements. Operation at larger angles can be accomplished, but with greater degradation of the signal strength and pattern sidelobes. The resultant fixed main reflector can be reinforced with struts to the ground or roof to withstand higher wind loads with less performance degradation.

Also, low-cost antennas for customer or "subscriber" premises, which may be deployed by the millions, are typically installed by relatively low-skill technicians and may be mounted to parts of residential structures which may shift enough to change the beam direction by more than the several tenths of a degree which is the acceptable limit for interactive applications. Conventional motorization of the antenna structure, i.e., motorizing the reflector mount to pivot and/or tilt the reflector in the azimuth and elevation planes would solve the problem, but is much too expensive to be practical.

SUMMARY OF THE INVENTION

In accordance with one aspect of the invention, a self-pointing antenna comprises an antenna comprising a reflector, a feed, an elongated boom arm coupled to said reflector and supporting said feed, and a pair of support struts coupled between said reflector and said boom arm; and an actuator operatively coupled with said support struts for permitting movement of said support struts for adjusting the position of said feed relative to said reflector so as to selectively adjust either/or both of the beam elevation and azimuth of a main beam axis of said antenna.

In accordance with another aspect of the invention, in an antenna structure, a method of self-directing a main beam axis of said antenna structure comprises supporting a feed on an elongated boom arm coupled to a reflector, supporting said boom arm by a pair of support struts extending between said reflector and said boom arm, and adjusting an effective length of said support struts to thereby adjust the position of said feed relative to said reflector so as to selectively adjust either/or both of a beam elevation and beam azimuth of the main beam axis of said antenna In accordance with another aspect of the invention a self-pointing antenna comprises means for supporting a feed on an elongated boom arm coupled to a reflector, means extending between said reflector and said boom arm for supporting said boom arm and means for adjusting an effective length of said means for supporting said boom arm to thereby adjust the position of said feed relative to said reflectors so as to selectively adjust either/or both of a beam elevation and beam azimuth of the main beam axis of said antenna.

In accordance with another aspect of the invention, a self-pointing antenna comprises a reflector, a sub-reflector and a plurality of support struts coupled between said reflector and said sub-reflector and supporting said sub-reflector; and an actuator adjusting the position of said sub-reflector relative to said reflector so as to selectively adjust in either or both of two orthogonal directions in a plane orthogonal to the antenna mechanical axis to allow automatic tracking of the antenna beam to the satellite motion. These directions will hereinafter be referred to as elevation and azimuth.

In accordance with another aspect of the invention, in a fixed antenna structure, a method of self-directing a main beam axis of said antenna structure comprises supporting a sub-reflector by a plurality of support struts extending between said reflector and said sub-reflector, and adjusting the position of said sub-reflector relative to said reflector so as to selectively adjust either/or both of a beam elevation and beam azimuth of the main beam axis of said antenna.

In accordance with another aspect of the invention a self-pointing antenna comprises means for supporting a sub-reflector operatively coupled to a reflector, and means for adjusting the position of said sub-reflector relative to said reflector so as to selectively adjust either/or both of a beam elevation and beam azimuth of the main beam axis of said antenna.

A self-pointing antenna comprising a reflector, one of a feed and a sub-reflector, and a plurality of support struts coupled between said reflector and said one of a feed and a sub-reflector and supporting said one of a feed and a sub-reflector, and at least one actuator for adjusting the position of said one of a feed and a sub-reflector relative to said reflector so as to selectively adjust either/or both of the beam elevation and azimuth of a main beam axis of said antenna.

In an antenna structure having a reflector and one of a feed and a sub-reflector, a method of self-directing a main beam axis of said antenna structure, said method comprising supporting a sub-reflector by a plurality of support struts extending between said reflector and said sub-reflector, and adjusting the position of said one of a feed and a sub-reflector relative to said reflector so as to selectively adjust either/or both of a beam elevation and beam azimuth of the main beam axis of said antenna.

A self-pointing antenna comprising a reflector and one of a feed and a sub-reflector means for supporting a sub-reflector operatively coupled to said reflector, and means for adjusting the position of said one of a feed and a subreflector relative to said reflector so as to selectively adjust either/or both of a beam elevation and beam azimuth of the main beam axis of said antenna.

DETAILED DESCRIPTION OF THE ILLUSTRATED EMBODIMENT

Figure 1:
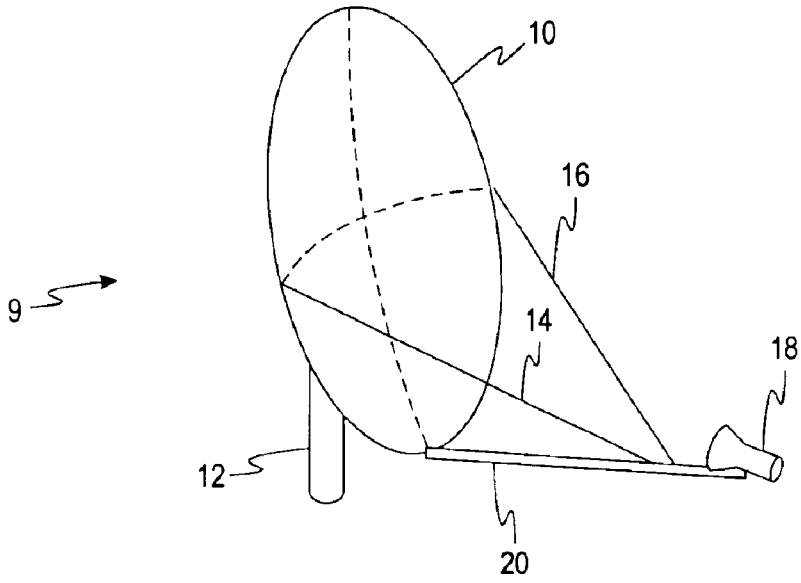
FIG. 1 Prior Art
FIG. 1 shows a conventional prime focus offset fed antenna.

Referring now to the drawings, FIG. 1 shows a conventional offset antenna 100. In this case it is a prime focus antenna (single reflector 10) but this invention also applies to dual-reflector antennas (not shown). The reflector 10 is supported on a mounting pole or pipe or column 12. Upon initial installation, the reflector 10 and its mounting pole 12 may be adjusted to the appropriate direction, insofar as possible, by the installer. Further adjustments for more accurately pointing the antenna beam may be accomplished in accordance with the invention as described hereinbelow. In the antenna 100 of FIG. 1, a feed such as a horn feed 18 is supported on the end of a boom arm 20 which projects from a bottom edge of the reflector 10. Also, support struts 14 and 16 project from opposite sides of the reflector 10 and support the end of the boom arm adjacent the feed 18. Support struts 14, 16 are not always used as such antennas, but are used with the present invention.

Figure 2:
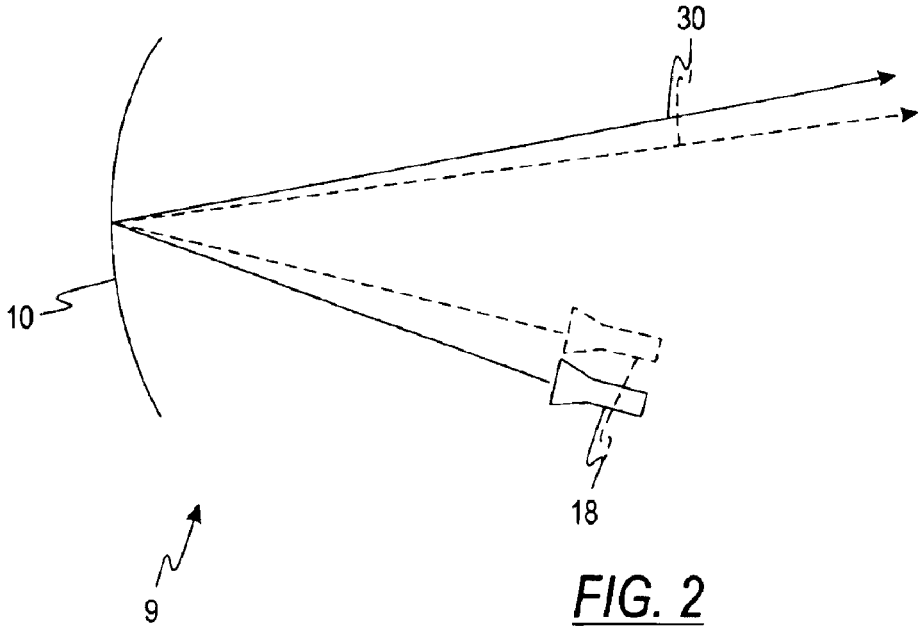
FIG. 2 Prior Art
FIG. 2 shows how the pointing or direction of such an antenna may be altered by moving (or "scanning") the feed slightly.

The present invention makes use of the realization that the pointing direction of the antenna 100 may be altered by moving (or "scanning") the feed 18 slightly, as shown in FIG. 2, without moving the reflector 10.

Figure 3:
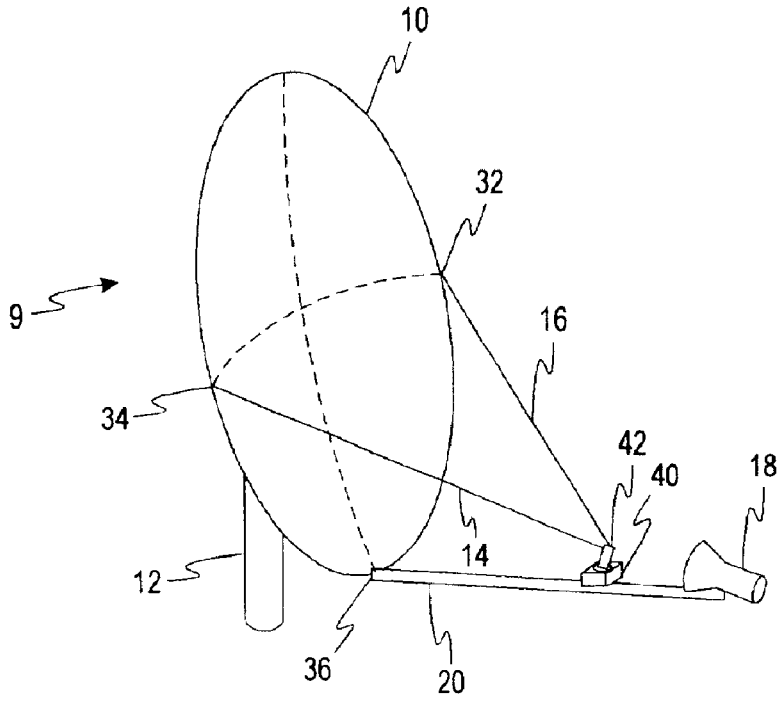
FIG. 3 shows one embodiment of the invention.

FIG. 3 shows one embodiment of the invention. The support struts 14, 16 (which could be ligatures, such as wires or the like) and the boom arm 20 are attached to the reflector 10 (or its back structure) with joints 32, 34, 36 that pivot slightly. These could be ball joints, hinges, or simply flexibility in the struts and boom arm themselves. In the embodiment of FIG. 3, the support struts 14, 16 are attached to a low-cost, limited motion, two-axis actuator 40, rather than to the boom arm 20. The actuator 40 is represented as a "joystick"-shaped device, in which the rod 42 can move in two axes. The struts are attached near the end of the rod 42. As the rod 42 moves back, the actuator 40 pulls on the struts 14, 16, lifting the boom arm 20, which has the effect of the scanning motion explained above, thus lowering the direction of the antenna's beam. Conversely, if the rod 42 moves forward, the boom arm 20 lowers, raising the antenna beam. The beam direction may be similarly moved in the azimuth axis by left and right movements of the arm. This is further illustrated in FIG. 4.

A motion of a small amount of the feed 18, relative to the reflector 20, will cause about the same amount of adjustment in the azimuth and/or elevation (depending upon the direction of movement) without causing significant scan loss or other performance degradation. For example, actuators of the type used for automotive applications (e.g., rear-view mirror glass actuators) are generally reliable and low cost for this purpose. The actuator may be operatively connected to an electronics module (not shown) to be directed by either a local or remote control, such as in response to automatic "peaking" detector or the like which detects signal strength or some other measure of signal quality and adjusts the beam elevation and/or azimuth for a maximum signal strength, for example, or for some other measurement of optimum signal condition. The logic and control system for this operation can be housed in the ground based electronics of the satellite system and commands to adjust the antenna direction can be transmitted to the antenna via the satellite, or other means. This in turn assures proper aiming of the antenna 100 for interactive/transmit purposes, for example for interactive satellite internet or TV services. This latter consideration is important, as noted above since many thousands or even millions of subscriber antennas, if misdirected even by relatively small amount can cause considerable interference with other radio frequency/satellite operations.

In this regard, the invention is contemplated for use in an interactive application such as wireless broadband internet interactive services. In these applications, typically the data satellite transmits in a 20 gigahertz band and receives signals in a 30 gigahertz band. Thus, conversely, the consumer or subscriber equipment would transmit signals in a 30 gigahertz band and receive signals in a 20 gigahertz band. The same antenna may also be used simultaneously to receive signals in another band, for example a 12 gigahertz band to receive satellite TV services. This can be accomplished through design of the feed horn, which is beyond the scope of the present application.

Figure 5:
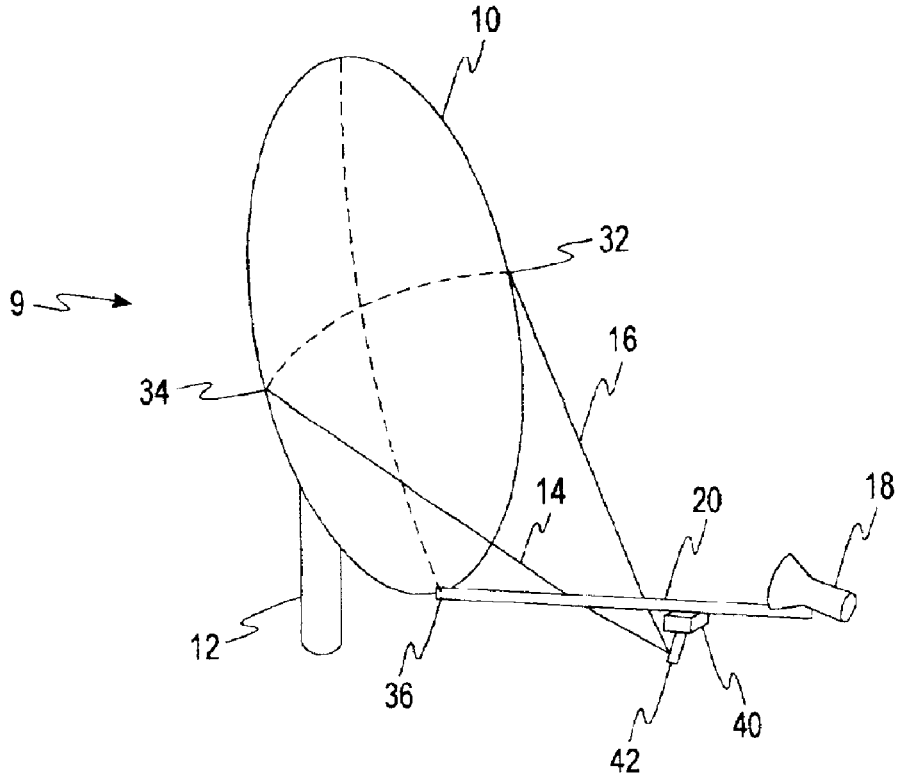
FIG. 5 shows an alternative embodiment with an actuator below the boom arm.

An alternative embodiment is shown in FIG. 5. In this case, the actuator device 40 is below the boom arm 20, thus reducing the proximity to the feed horn 18 and improving the antenna's pattern performance by reducing blockage effects.

Figure 4:
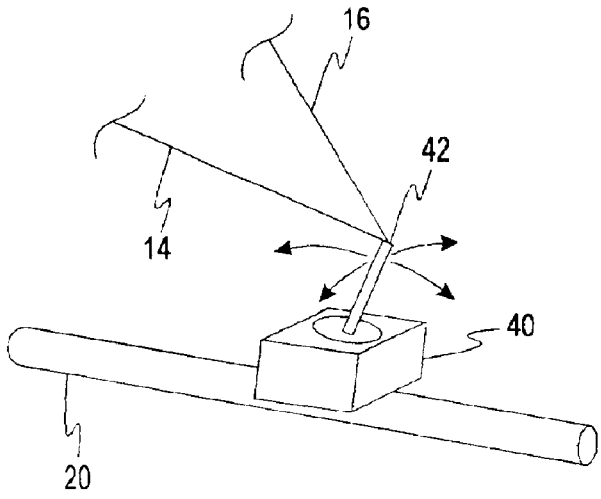
FIG. 4 is an enlarged view of a portion of FIG. 3.
Figure 5A:
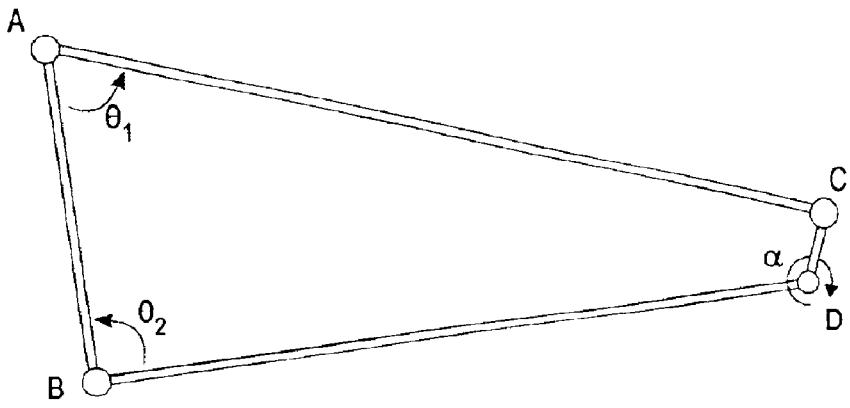
FIG. 5*a* is a diagram illustrating the principles of operation of the embodiment of FIGS. 3 and 4.
Figure 5B:
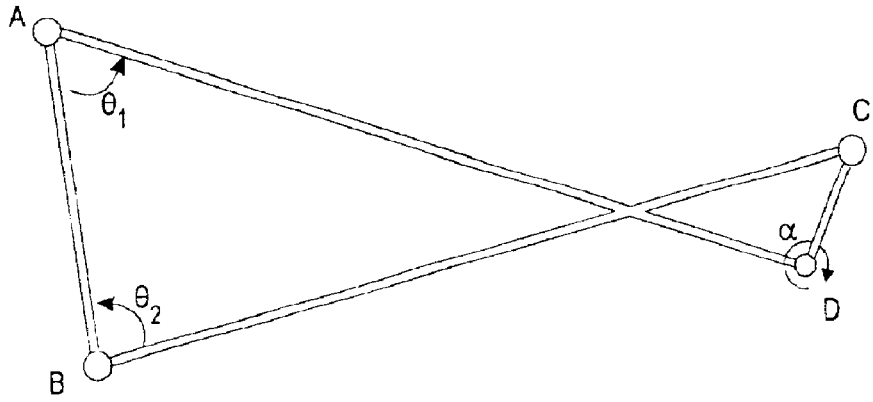
FIG. 5*b* is a diagram illustrating the principles of operation of the embodiment of FIG. 5.

The mechanical principle underlying the examples in FIGS. 3, 4 and 5 is illustrated in FIGS. 5*a* and 5*b*. In these figures, a mechanism with four fixed-length sides has three joints which are free to pivot (points A, B, and C). Two points, typically A and B, are fixed with respect to the antenna's reflector; sides A–C or B–D represent a boom arm and strut (or vice versa) respectively. Therefore angle $\theta_1$ and $\theta_2$ represents the antenna beam direction angle. When a driving torque is applied at joint D, angle $\alpha$ is varies, thus causing $\theta_1$ and $\theta_2$ to vary. The core of the invention is that if side C–D is short compared to A–C or B–D, a large change in $\alpha$ causes small changes in $\theta_1$ and $\theta_2$. This mechanical advantage permits the use of inexpensive low-torque, small-motion actuators to achieve a fine pointing adjustment together with structural elements (boom arm and strut) that are inherent components of a fixed antenna.

These principles apply to the geometry in FIG. 5*b* (refer to example in FIG. 5) as well as the geometry in FIG. 5*a* (refer to example in FIG. 3).

Figure 6:
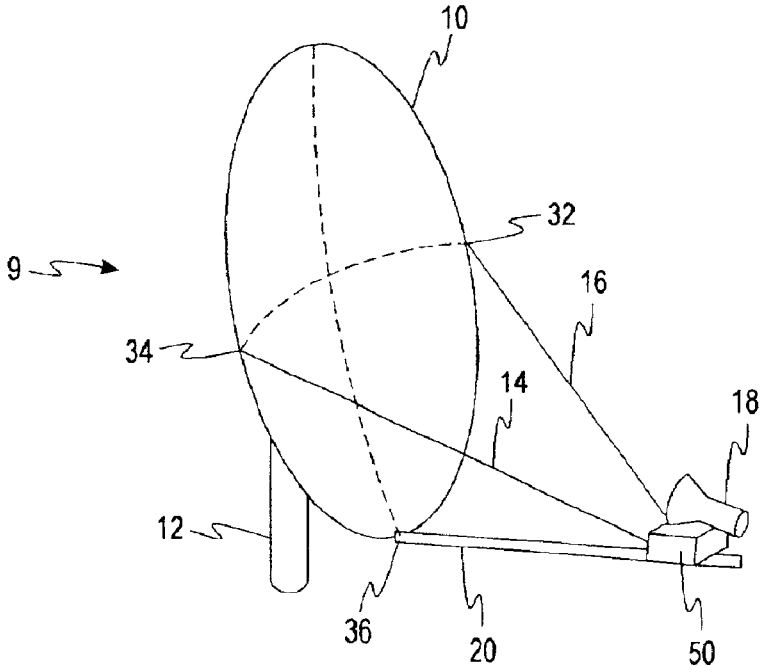
FIG. 6 shows an embodiment using extender/retractor devices.

An alternate, somewhat different principle, the use of extender/retractor devices instead of the rotational-movement actuators, would accomplish a similar objective. An example of such an actuator 50 is shown in FIG. 6. This would allow the use of devices such as throttle control actuators which may be more cost-effective and is available with the appropriate force.

Figure 7:
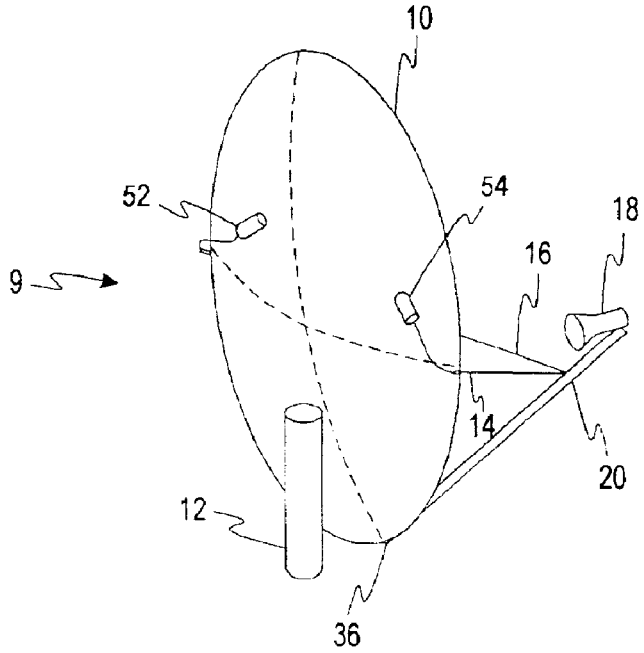
FIG. 7 is an embodiment using cable drive devices.
Figure 8:
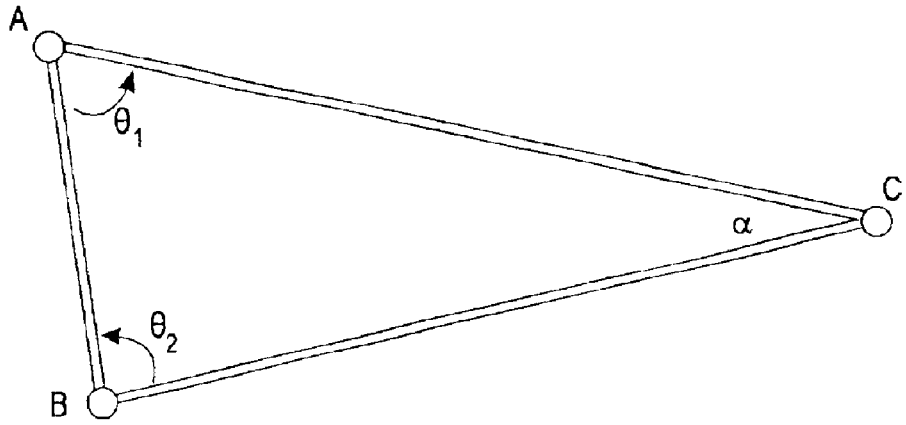
FIG. 8 is a diagram illustrating the principles of operation of the embodiments of FIGS. 6 and 7.

Another embodiment would use cable extender/retractor devices 52, 54, as illustrated in FIG. 7. In this case the cable could extend to form the support wires 14, 16 for the boom 20, and the motor drives 52, 54 would remain on the rear of the reflector, which may offer better mounting strength. This latter principle is illustrated in FIG. 8. Small adjustments in the length of side A–C cause fine adjustment in $\theta_1$ and $\theta_2$.

Figure 9:
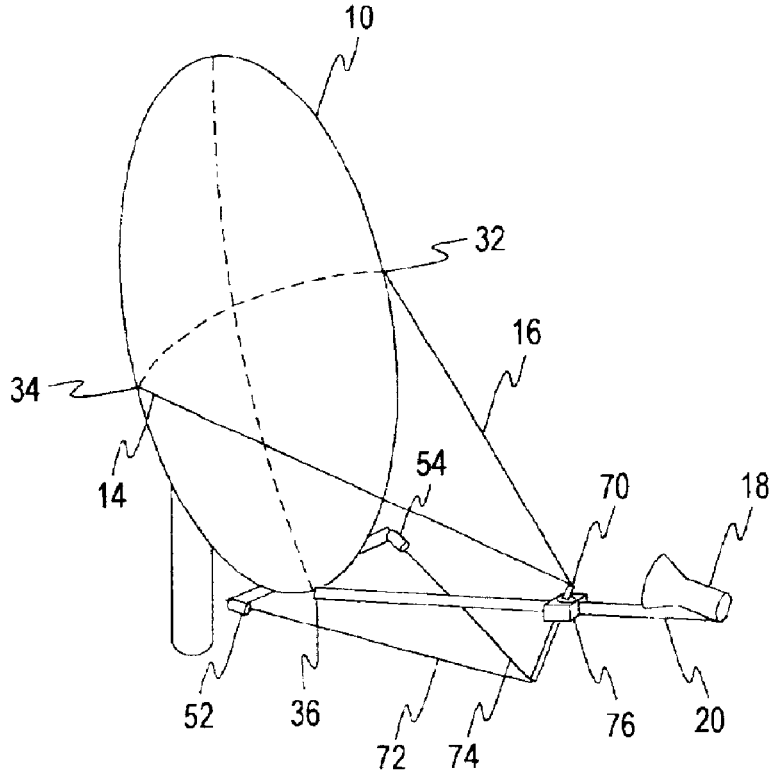
FIG. 9 is a view similar to FIGS. 3–6 showing a combination of features of the embodiments illustrated therein.
Figure 10:
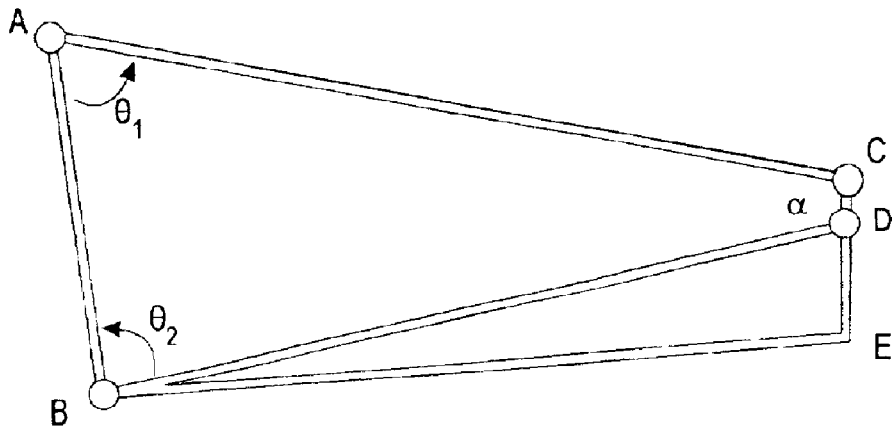
FIG. 10 is a diagram illustrating the principles of operation of the embodiment of FIG. 9.

An embodiment which uses both principles is illustrated in the example of FIG. 9. Here, the extender/retractor devices 52, 54 move the lower end of a lever 70 by acting on auxiliary struts/cables 72, 74. The lever attaches to the boom arm with a two-axis pivot 76. Extension of the auxiliary struts causes the lever 70 to rotate. The upper end of the lever 70 acts on the main support strut/wires 14, 16. Equal operation of the extender devices 52, 54 causes elevations beam adjustments, whereas differential operation causes azimuth beam adjustment. The unequal length of the lever 70 above and below the 2-axis pivot joint 76 gives mechanical advantage to the extender devices 52, 54, enabling the use of lower-cost lower-force units. The combined principle shown in FIG. 9 is illustrated schematically in FIG. 10. The ratio of lengths CD to DE determines the mechanical advantage.

The low cost of the invention allows it to be installed in consumer antennas, greatly reducing the expense and labor of large numbers of antennas requiring periodic on-site service for repainting. It also reduces the risk of a large population of antennas causing interference and the consequent possibility of mandated terminal or network shutdowns. The invention makes antenna design easier by reducing the off-axis angle over which specifications must be met. It also reduces the cost of installation labor and the training requirements for installers, and reduces the cost of the initial installation by eliminated the need for fine vernier adjustment (for example, use of the invention might allow the use of simple clamp adjustments only for installation, with the fine adjustment being handled by the invention).

Figure 11:
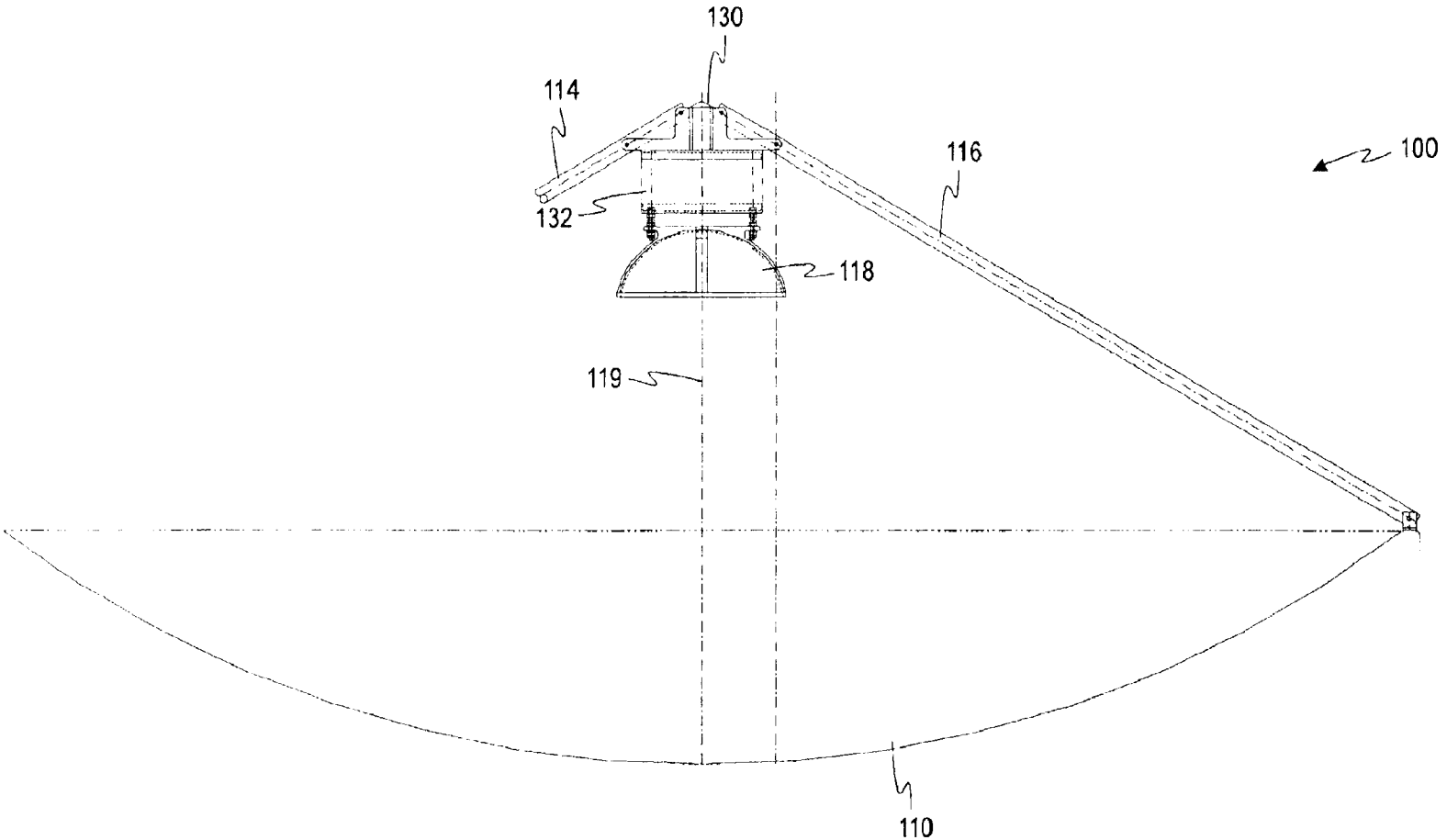
FIG. 11 shows, in simplified form, an antenna assembly in accordance with another embodiment of the invention.

In the embodiment of FIG. 11, an antenna 101 includes a sub-reflector 118 attached to a two axis motorized carriage 132 which in turn is supported by three or four (or more) struts 114, 116 attached to a large main reflector 110, only two of which struts 114, 116 are visible in FIG. 11. Each of the two orthogonal mechanisms of the two axis motorized carriage 132 includes a lead screw 138, 140 and one or two guide rails 142, 144 (see FIGS. 12 and 13). An electric gear motor 134, 136 is attached to each lead screw with a counter or other angular readout device 137, 139 attached to each output shaft to allow closed loop control of the position. The antenna beam is thus scanned with respect to its mechanical axis. Pattern degradation with scan angle is negligible for small angles of scan.

Referring to the drawings in more detail, FIG. 11 shows a dual reflector antenna 101. The embodiment shown for purposes of description is a 3.5 meter, KA-band antenna assembly. However, the invention may be configured for use with other antenna assemblies of this general type, and with other specific configurations, without departing from the invention, as will be seen from the following description.

The main reflector 110 is supported on a mounting pole or pipe or column or other appropriate structure (not shown). Upon initial installation, the reflector 110 and its mounting structure may be adjusted to the appropriate direction, insofar as possible, by the installer. Further adjustments for more accurately pointing the antenna beam may be accomplished in accordance with the invention as described hereinbelow. In the antenna 101 of FIG. 11, a sub-reflector 118 is supported by support struts 114 and 116 which project from side edges of the reflector 110 and attach to a mounting bracket 130 to support the sub-reflector 118. A feed horn (not shown) is appropriately mounted so that its phase center 119 is in the desired position relative to the sub-reflector 118.

Figure 13:
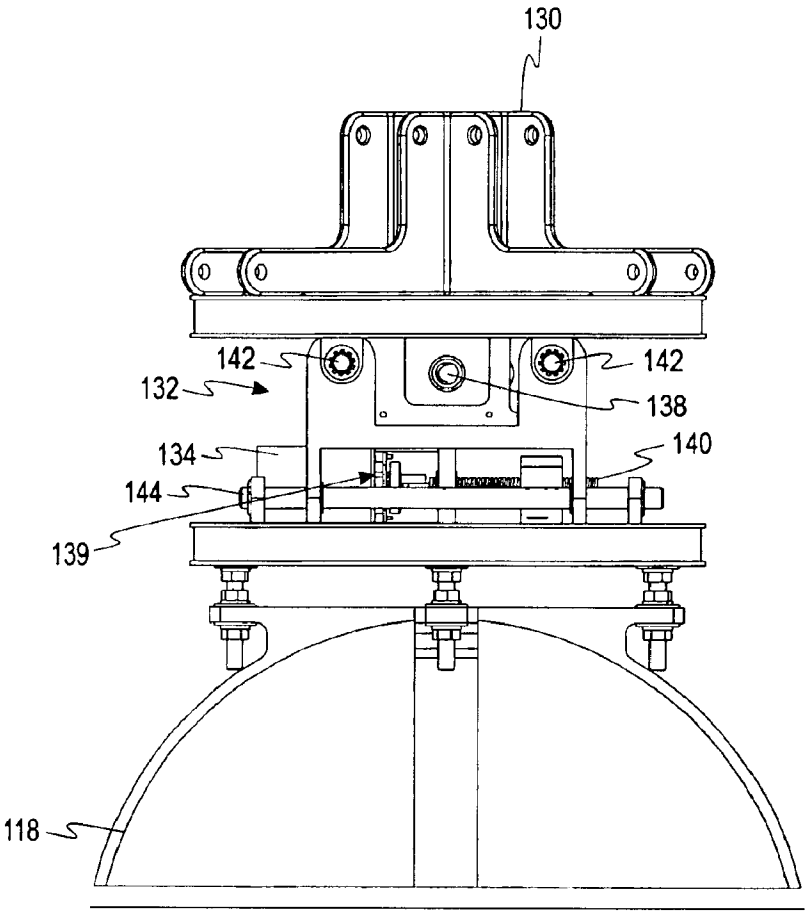
FIG. 13 is a view similar to FIG. 12, and taken in an orthogonal plane.
Figure 12:
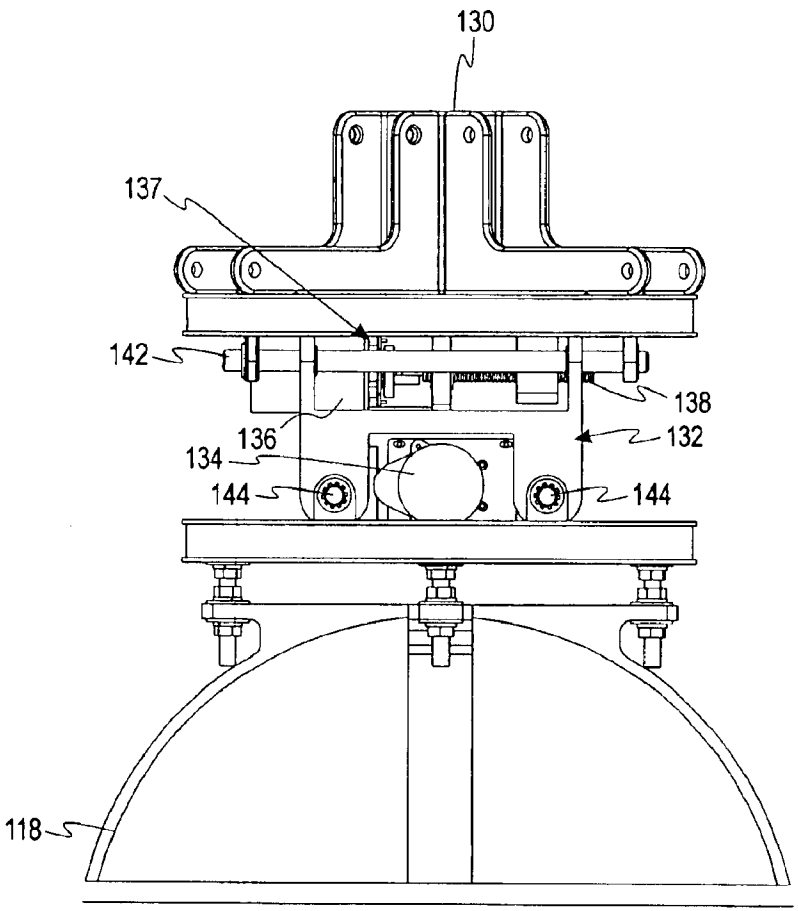
FIG. 12 is an enlarged view of a sub-reflector and a two axis carriage of the embodiment of FIG. 11.

The present invention makes use of the realization that the pointing direction of the antenna 101 may be altered by moving (or "scanning") the sub-reflector 118 slightly, in the manner shown in FIGS. 12 and 13, without moving the reflector 110.

In the illustrated embodiment, the sub-reflector 118 is mounted to the struts 114, 116 (which are preferably 3 or 4 in number, although only two such struts are visible in the view illustrated in FIG. 11) by the mounting bracket or fitting 130. The mounting bracket or fitting 130 holds a two axis moving carriage or actuator 132 which in turn mounts the sub-reflector 118 for movement in two orthogonal directions. Accordingly, the sub-reflector 118 may be moved a small amount relative to the main reflector 110 to thereby adjust the beam elevation and/or azimuth as desired, for example, in order to assure accurate tracking of a satellite.

Referring to FIGS. 12 and 13, and an enlarged view of the sub-reflector 118, mounting bracket 130 and actuator or carriage 132 are shown. In the embodiment illustrated, the carriage 132 includes respective gear motors 134, 136 which drive respective drive screws 138 and 140. These drive screws in turn cause motion of the carriage 132 relative to support rods 142 and 144 in orthogonal directions.

While a particular embodiment of the invention has been illustrated, it will be understood that movement of the sub-reflector relative to the main reflector may be achieved by other specific mechanisms without departing from the invention. In particular, the specific mechanisms and directions of movement may vary, including, without limitation, movement in different specific directions, movement in additional directions to those illustrated, tilting or angular movement, and the like, without departing from the invention. Moreover, movement of the sub-reflector may be achieved by mechanical movement of the support struts 114, 116 (and additional support struts not illustrated in FIG. 11) with or without use of the carriage 132 as described above. That is, the effective length and/or position of the support struts may be varied by mechanical means to achieve similar movement of the sub-reflector 118 with respect to the main reflector 110 without departing from the present invention.

A motion of a small amount of the sub-reflector 118, relative to the reflector 110, will cause about the same amount of adjustment in the azimuth and/or elevation (depending upon the direction of movement) without causing significant scan loss or other performance degradation. The actuator may be operatively connected to an electronics module (not shown) to be directed by either a local or remote control, such as in response to automatic "peaking" detector or the like which detects signal strength or some other measure of signal quality and adjusts the beam elevation and/or azimuth for a maximum signal strength, for example, or for some other measurement of optimum signal condition. The logic and control system for this operation can be housed on site with the antenna, or in the ground based electronics of the satellite system. In the latter case, commands to adjust the antenna direction can be transmitted to the antenna via a wire or wireless link, or the satellite, or by other means. This in turn assures proper aiming of the antenna 101.

The foregoing describes a method and apparatus for moving a subreflector to scan an antenna beam over small angles to follow the movement of a satellite in "fixed orbits."In general, satellites in "fixed" orbits do move a small amount on a daily basis and are corrected periodically to keep them with a fixed box of small angular extent. The daily movement of the satellite must be tracked by very large, high frequency antennas which have a beamwidth small such as to approach that of the box.

Figure 14:
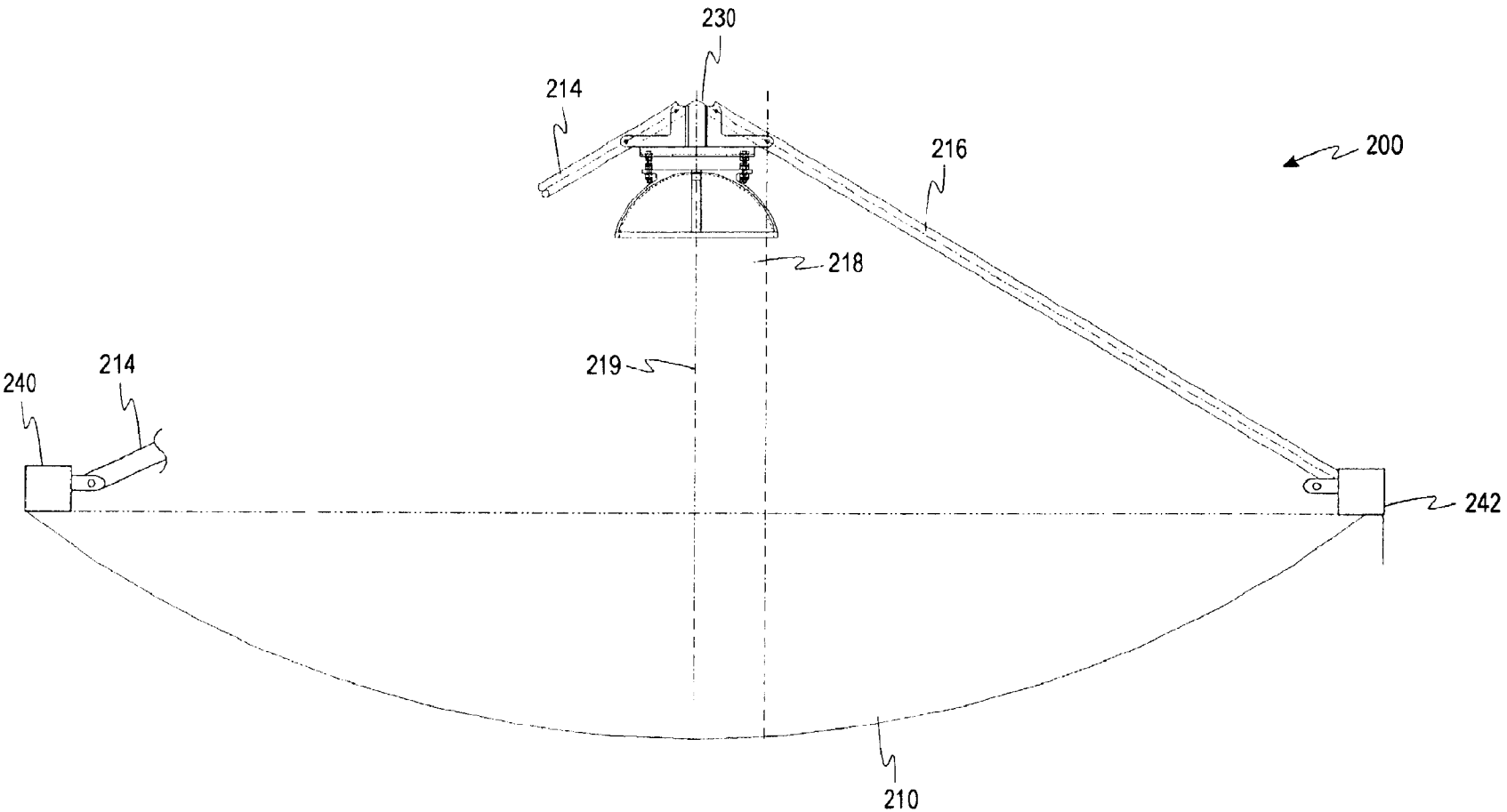
FIG. 14 is a view similar to FIG. 11 showing another embodiment.

The embodiment of FIG. 14 makes use of small jack screws at the feed (or subreflector) support strut/main reflector interface to essentially change the length of each strut to accomplish the desired motion of the feed (or subreflector). This results in greater accuracy of movement, simplicity of design, and the ability to repair or replace the jack screws without interfering with the operation of the antenna.

A controller (not shown) may be used to calculate and position each jack screw length as required for the desired beam pointing angle. A ball joint is placed at each jack screw strut interface allow for slight angular movement seen at that interface. A device is attached to each jack screw rotating shaft to provide feedback of the rotation angle (length) motion to the controller.

In this regard, FIG. 14 illustrates an embodiment in which actuators, for example, in the form of jack screws 240 and 242 are operatively coupled with at least two of the struts 214 and 216. In this regard, the actuators may be coupled with three or four of the struts (other struts not visible in FIG. 14) to achieve the desired movement of the sub-reflector 218 relative to the main reflector 210. In FIG. 14, like reference numerals have been used with the prefix 2 to indicate like elements and components. Thus, the antenna assembly is designated by reference 200, with support struts 214, 216, mounting bracket 230, sub-reflector 218, main reflector 210, etc. In FIG. 14, the sub-reflector 218 is coupled directly with the bracket 230, omitting the actuator 132 in the embodiment of FIGS. 11–13, and relying instead on the actuators or jack screws 240, 242 to achieve the desired motion.

The invention makes antenna design easier by reducing the off-axis angle over which specifications must be met. It also reduces the cost of installation labor and the training requirements for installers, and reduces the cost of the initial installation by eliminated the need for fine vernier adjustment (for example, use of the invention might allow the use of simple adjustments only for installation, with the fine adjustment being handled by the invention).

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A self-pointing antenna comprising:

an antenna comprising a reflector, a feed, an elongated boom arm coupled to said reflector and supporting said feed, and a pair of support struts coupled between said reflector and said boom arm; and a signal actuator operatively coupled with said support struts for permitting movement of said support struts for adjusting the position of said feed relative to said reflector so as to selectively adjust either/or both of the beam elevation and azimuth of a main beam axis of said antenna.

2. The antenna of claim 1 wherein said actuator is mounted to said boom arm and comprises a two-axis actuator.

3. The antenna of claim 2 wherein said actuator is mounted to a top side of said boom arm.

4. The antenna of claim 2 wherein said actuator is mounted to a bottom side of said boom arm.

5. The antenna of claim 2 wherein said actuator comprises an automotive mirror-glass actuator.

6. The antenna of claim 1 wherein each of said support struts comprises an elongated ligature and said actuator comprises a mechanism for adjusting the effective length of one or both of said ligatures.

7. The antenna of claim 6 wherein said actuator is mounted to said boom arm.

8. The antenna of claim 6 wherein said actuator is mounted to said reflector.

9. In an antenna structure, a method of self-directing a main beam axis of said antenna structure, said method comprising:

supporting a feed on an elongated boom arm coupled to said reflector;

supporting said boom arm by a pair of support struts extending between said reflector and said boom arm; and adjusting an effective length of one or both of said support struts by providing a signal actuator to thereby adjust the position of said feed relative to said reflectors so as to selectively adjust either/or both of a beam elevation and beam azimuth of the main beam axis of said antenna.

10. The method of claim 9 wherein said adjusting comprises mounting said actuator to said boom arm and support struts.

11. The method of claim 10 wherein said actuator is mounted to a top side of said boom arm.

12. The method of claim 10 wherein said actuator is mounted to a bottom side of said boom arm.

13. A self-pointing antenna comprising:

an antenna comprising a reflector, a feed, an elongated boom arm coupled to said reflector and supporting said feed, and a pair of support struts coupled between said reflector and said boom arm; and a single actuator placed in a single location operatively coupled with said support struts for permitting movement of said support struts and/or said boom arm for adjusting the position of said feed relative to said reflector so as to selectively adjust either/or both of the beam elevation and azimuth of a main beam axis of said antenna.

14. The antenna of claim 13 wherein said actuator connects said boom arm to said support struts and by rotation of the actuator causes the angle between the struts and boom arm to be adjusted.

15. The antenna of claim 14 wherein said actuator is mounted to said boom arm and comprises a two-axis actuator.

16. The antenna of claim 15 wherein said actuator is mounted to a top side of said boom arm.

17. The antenna of claim 16 wherein said actuator is mounted to a bottom side of said boom arm.

18. The antenna of claim 15 wherein said actuator comprises an automotive actuator.

19. The antenna of claim 13 wherein each of said support struts comprises an elongated ligature and said actuator comprises a mechanism for adjusting the effective length of one or both of said ligatures.

20. The antenna of claim 19 wherein said actuator is mounted to said boom arm.

21. The antenna of claim 19 wherein said actuator is mounted to said reflector.

22. A self-pointing antenna comprising:

a reflector, a feed and a sub-reflector, and a plurality of support struts coupled between said reflector and said sub-reflector and supporting said sub-reflector, and a single actuator for adjusting the position of said sub-reflector relative to said reflector so as to selectively adjust either/or both of the beam elevation and azimuth of a main beam axis of said antenna.

23. The antenna of claim 22 wherein said actuator is mounted to said sub-reflector and comprises a two-axis actuator.

24. The antenna of claim 22 wherein said actuator is mounted to said sub-reflector.

25. The antenna of claim 24 wherein said actuator comprises a two-axis motorized carriage.

26. The antenna of claim 22 wherein said actuator comprises a two-axis motorized carriage.

27. The antenna of claim 22 wherein said actuator comprises a pair of orthogonally acting mechanisms, each comprising a lead screw and at least one guide rail and a motor attached to said lead screw.

28. The antenna of claim 27 wherein said actuator is mounted to said sub-reflector.

29. The antenna of claim 27 and further including a readout device operatively coupled to said actuator to allow closed loop control of the position of said sub-reflector.

30. The antenna of claim 22 and further including a readout device operatively coupled to said actuator to allow closed loop control of the position of said sub-reflector.

31. The antenna of claim 22 wherein said single actuator is further adapted to adjust the position of said feed relative to said reflector so as to selectively adjust either/or both of the beam elevation and azimuth of a main beam axis of said antenna.

32. In an antenna structure having a reflector, a feed and a sub-reflector, a method of self-directing a main beam axis of said antenna structure, said method comprising:

supporting said sub-reflector by a plurality of support struts extending between said reflector and said sub-reflector; and adjusting the position of said sub-reflector relative to said reflector so as to selectively adjust either/or both of a beam elevation and beam azimuth of the main beam axis of said antenna, wherein said adjusting comprises operating a single actuator mounted to said sub-reflector and said support struts.

33. The method of claim 32, wherein said antenna structure comprises both said feed and said sub-reflector and the method further comprises adjusting the position of said feed relative to said reflector so as to selectively adjust either/or both of a beam elevation and beam azimuth of the main beam axis of said antenna.

34. A self-pointing antenna comprising:

a reflector, a feed and a sub-reflector means for supporting a sub-reflector operatively coupled to said reflector; and means for adjusting the position of said sub-reflector relative to said reflector so as to selectively adjust either/or both of a beam elevation and beam azimuth of the main beam axis of said antenna, said adjusting means comprising a single actuator.

35. The antenna of claim 34 wherein said actuator is mounted to said sub-reflector.

36. The antenna of claim 35 wherein said actuator comprises a two-axis motorized carriage.

37. The antenna of claim 36 wherein said actuator comprises a pair of orthogonally acting mechanisms, each comprising a lead screw and at least one guide rail and a motor attached to said lead screw.

38. The antenna of claim 37 and further including a readout device operatively coupled to said actuator to allow closed loop control of the position of said sub-reflector.

39. The antenna of claim 36 and further including a readout device operatively coupled to said actuator to allow closed loop control of the position of said sub-reflector.

40. The antenna of claim 34 wherein said actuator comprises a two-axis motorized carriage.

41. The antenna of claim 34, wherein said means for adjusting the position of said sub-reflector is further adapted to adjust the position of said feed relative to said reflector so as to selectively adjust either/or both of the beam elevation and azimuth of a main beam axis of said antenna.

42. In an antenna structure having a reflector, a feed, and a sub-reflector, a method of self-directing a main beam axis of said antenna structure, said method comprising:

supporting said sub-reflector by a plurality of support struts extending between said reflector and said sub-reflector; and adjusting either/or both of a beam elevation and beam azimuth of the main beam axis of said antenna by adjusting the position of said both of said feed and said sub-reflector relative to said reflector.

43. In an antenna structure having a reflector, feed and a sub-reflector, a method of self-directing a main beam axis of said antenna structure, said method comprising:

supporting said sub-reflector by a plurality of support struts extending between said reflector and said sub-reflector; and adjusting either/or both of a beam elevation and beam azimuth of the main beam axis of said antenna by adjusting the position of said sub-reflector relative to said reflector and by adjusting the position of said feed relative to said reflector.

44. In an antenna structure, a method of self-directing a main beam axis of said antenna structure, said method comprising:

supporting a feed on an elongated boom arm coupled to said reflector;

supporting said boom arm by a pair of support struts extending between said reflector and said boom arm; and adjusting either/or both of a beam elevation and beam azimuth of the main beam axis of said antenna by adjusting a effective length of one or both of said support struts to thereby adjust the position of said feed relative to said reflector wherein said adjusting comprises mounting an actuator to said boom arm support struts.

45. The method of claim 44 wherein said actuator is mounted to a top side of said boom arm.

46. The method of claim 44 wherein said actuator is mounted to a bottom side of said boom arm.

* * * * *

UNITED STATES PATENT AND TRADEMARK OFFICE

CERTIFICATE OF CORRECTION

PATENT NO. : 6,943,750 B2
DATED : September 13, 2005
INVENTOR(S) : Ralph L. Brooker et al.

It is certified that error appears in the above-identified patent and that said Letters Patent is hereby corrected as shown below:

Column 8,
Lines 11 and 43, "signal" should be -- single --.

Signed and Sealed this

Ninth Day of May, 2006

JON W. DUDAS
*Director of the United States Patent and Trademark Office*